US010463216B2

(12) United States Patent
Emmett et al.

(10) Patent No.: US 10,463,216 B2
(45) Date of Patent: Nov. 5, 2019

(54) WAND AND HOSE ASSEMBLY FOR A VACUUM CLEANER

(71) Applicant: Dyson Technology Limited, Wiltshire (GB)

(72) Inventors: David William Emmett, Bristol (GB); David Christopher James Newton, Bristol (GB); Stephen Robert Dimbylow, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 321 days.

(21) Appl. No.: 15/479,602

(22) Filed: Apr. 5, 2017

(65) Prior Publication Data

US 2017/0290484 A1 Oct. 12, 2017

(30) Foreign Application Priority Data

Apr. 8, 2016 (GB) ..... 1606175.6

(51) Int. Cl.

| | |
|---|---|
| ***A47L 9/24*** | (2006.01) |
| ***A47L 5/22*** | (2006.01) |
| ***A47L 5/32*** | (2006.01) |
| ***A47L 9/00*** | (2006.01) |
| ***A47L 9/32*** | (2006.01) |

(52) U.S. Cl.

CPC ..... *A47L 9/244* (2013.01); *A47L 5/225* (2013.01); *A47L 5/32* (2013.01); *A47L 9/0045* (2013.01); *A47L 9/246* (2013.01); *A47L 9/325* (2013.01); *A47L 9/327* (2013.01); *A47L 9/248* (2013.01)

(58) Field of Classification Search

CPC . A47L 9/244; A47L 5/225; A47L 5/32; A47L 9/0045; A47L 9/325; A47L 9/327; A47L 9/242; A47L 9/248

See application file for complete search history.

(56) References Cited

U.S. PATENT DOCUMENTS

| | | | | |
|---|---|---|---|---|
| 2002/0189046 | A1* | 12/2002 | Nighy | A47L 9/242 15/327.1 |
| 2004/0163202 | A1 | 8/2004 | Yoshimi et al. | |
| 2004/0261211 | A1 | 12/2004 | Overvaag et al. | |
| 2006/0070208 | A1* | 4/2006 | Follegot | A47L 5/225 15/344 |

(Continued)

FOREIGN PATENT DOCUMENTS

| | | |
|---|---|---|
| GB | 2 451 680 | 2/2009 |
| GB | 2474478 | 4/2011 |

(Continued)

OTHER PUBLICATIONS

Search Report dated Sep. 28, 2016, directed to GB Application No. 1606175.6; 1 page.

*Primary Examiner* — Andrew A Horton

(74) *Attorney, Agent, or Firm* — Morrison & Foerster LLP

(57) ABSTRACT

A wand and hose assembly for a vacuum cleaner includes a suction wand fluidly connected to the end of a suction hose by a duct and the duct incorporates an articulating joint for allowing articulated movement of the suction wand relative to the end of the suction hose. The wand and the duct are arranged for telescopic sliding movement relative to one another, and the articulating joint is moveable into a position in which the wand can slide telescopically through the duct for retraction into the suction hose.

12 Claims, 9 Drawing Sheets

(56) References Cited

U.S. PATENT DOCUMENTS

2011/0209301 A1 9/2011 Seo et al.

FOREIGN PATENT DOCUMENTS

| | | |
|---|---|---|
| JP | 5-84197 | 4/1993 |
| JP | 5-161580 | 6/1993 |
| JP | 2001-275906 | 10/2001 |
| JP | 2002-233482 | 8/2002 |
| JP | 2004-166889 | 6/2004 |
| JP | 2004-261587 | 9/2004 |
| JP | 2006-314569 | 11/2006 |
| JP | 2006-326093 | 12/2006 |
| JP | 2006-326186 | 12/2006 |
| JP | 2006-334098 | 12/2006 |
| JP | 2006-334157 | 12/2006 |
| JP | 2006-346115 | 12/2006 |
| JP | 2007-044430 | 2/2007 |
| JP | 2007-054303 | 3/2007 |
| JP | 2007-089749 | 4/2007 |
| JP | 2007-135651 | 6/2007 |
| KR | 20-0205694 | 9/2000 |
| KR | 10-0774509 | 11/2007 |
| KR | 10-0962731 | 6/2010 |
| WO | WO-99/35954 | 7/1999 |

* cited by examiner

WAND AND HOSE ASSEMBLY FOR A VACUUM CLEANER

REFERENCE TO RELATED APPLICATIONS

This application claims the priority of United Kingdom Application No. 1606175.6, filed Apr. 8, 2016, the entire contents of which is incorporated herein by reference.

FIELD OF THE INVENTION

The present invention relates to a wand and hose assembly for a vacuum cleaner.

BACKGROUND OF THE INVENTION

A so-called wand and hose assembly for a vacuum cleaner is an assembly which comprises a suction wand fluidly connected to a suction hose. The suction hose is connected in use to a vac-motor on board the vacuum cleaner which draws dirty air in through the end of the suction wand, along the suction hose and into a dust separator provided on the vacuum cleaner. Wand and hose assemblies are provided as standard on cylinder vacuum cleaners, but they are also provided on upright vacuum cleaners, too—in addition to the main, fixed cleaner head—in order to make it easier to clean above the level of the floor.

The suction hose itself is a flexible hose which is intended to allow the user freely to manipulate the suction wand. In practice, however, the relative stiffness of a conventional vacuum cleaner suction hose does mean that it can tend to inhibit or impede free manipulation of the suction wand. This can make the suction wand awkward to manoeuvre and may result in user fatigue.

SUMMARY OF THE INVENTION

According to some aspects, the present invention provides a wand and hose assembly for a vacuum cleaner, the assembly comprising a suction wand fluidly connected to the end of a suction hose by a duct, the duct incorporating an articulating joint for allowing articulated movement of the suction wand relative to the end of the suction hose, the wand and the duct being arranged for telescopic sliding movement relative to one another, the articulating joint being moveable into a position in which the wand can slide telescopically through the duct for retraction into the suction hose.

The effect of providing an articulating joint between the suction wand and the suction hose is that the user is able to manoeuvre the suction wand more easily, without being unduly inhibited by the stiffness of the suction hose.

In some circumstances it may be advantageous in a wand and hose assembly for the suction wand to be retractable inside the suction hose. This reduces the storage 'footprint' of the wand and hose assembly when it is not in use. By arranging the articulated joint so that it can be moved to a position in which the wand can slide through the duct sections, it is possible for the wand to be retracted inside the suction hose for storage.

Reducing the storage footprint of the wand and hose assembly is particularly advantageous on an upright vacuum cleaner because here the wand is typically stored on board the vacuum cleaner when the vacuum cleaner is being used in upright mode.

The articulated joint may be a ball-joint which provides multiple degrees of freedom.

Alternatively, the articulated joint may be an elbow joint permitting movement about a single pivot axis (P), the elbow joint being moveable between a bent-arm position and a straight-arm position in which the wand can slide telescopically through the duct for retraction into the suction hose.

The use of an elbow joint reduces the number of degrees of freedom compared to a ball-joint, but has the benefit that it simplifies the design.

The elbow joint is preferably arranged to permit sufficient relative rotation of the wand and hose about the pivot axis to vary the working angle between the hose and the wand by 100 degrees.

The duct may comprise a first duct section and a second duct section joined to the first duct suction by the elbow joint. The elbow joint itself may comprise a flexible tube which can bend to provide the necessary articulation between the duct sections. Alternatively though, the elbow joint may comprise a socket formed at the end of the first duct section which receives a head formed at the respective end of the second duct section, the socket and the head being shaped co-operatively to permit relative movement of the duct sections about the pivot axis (P), a lip seal member being provided between in the space between the socket and the head to provide a dynamic air seal between the duct sections.

The use of a socket and head arrangement provides the advantage of robustness compared to a flexible tube, which may tear in use.

The lip seal preferably forms a seal against one or more convex walls on the head, the convex wall(s) arcing around the pivot axis. This sort of arrangement has the advantage that as the head is rotated about the pivot axis (P), the space between the socket and head remains constant in the region of the lip seal. This helps to ensure consistent sealing between the duct sections as the working angle between the hose and wand is varied.

The socket may comprise an outer concave wall which, when the elbow joint is in the bent-arm position, acts to guide airflow around the elbow. This helps to reduce pressure losses in the duct.

The elbow joint may additionally comprise an external pin joint between the duct sections, which pin joint defines the pivot axis (P). This helps to stabilise the joint.

The duct sections are preferably rigid, although this is not strictly essential.

The wand and hose assembly may be provided on an upright vacuum cleaner specifically, although this is not essential.

A handle may be provided on the second duct section. This aids manoeuvring of the wand by the user. The handle is preferably of the type which forms a closed loop, in this case with the second duct section. The handle may include two separate grip portions, which provides alternative locations for the user to grip the handle.

BRIEF DESCRIPTION OF THE DRAWINGS

An embodiment of the invention will be described, by way of example, with reference to the accompanying drawings, in which.

DETAILED DESCRIPTION OF THE INVENTION

Figure 1:
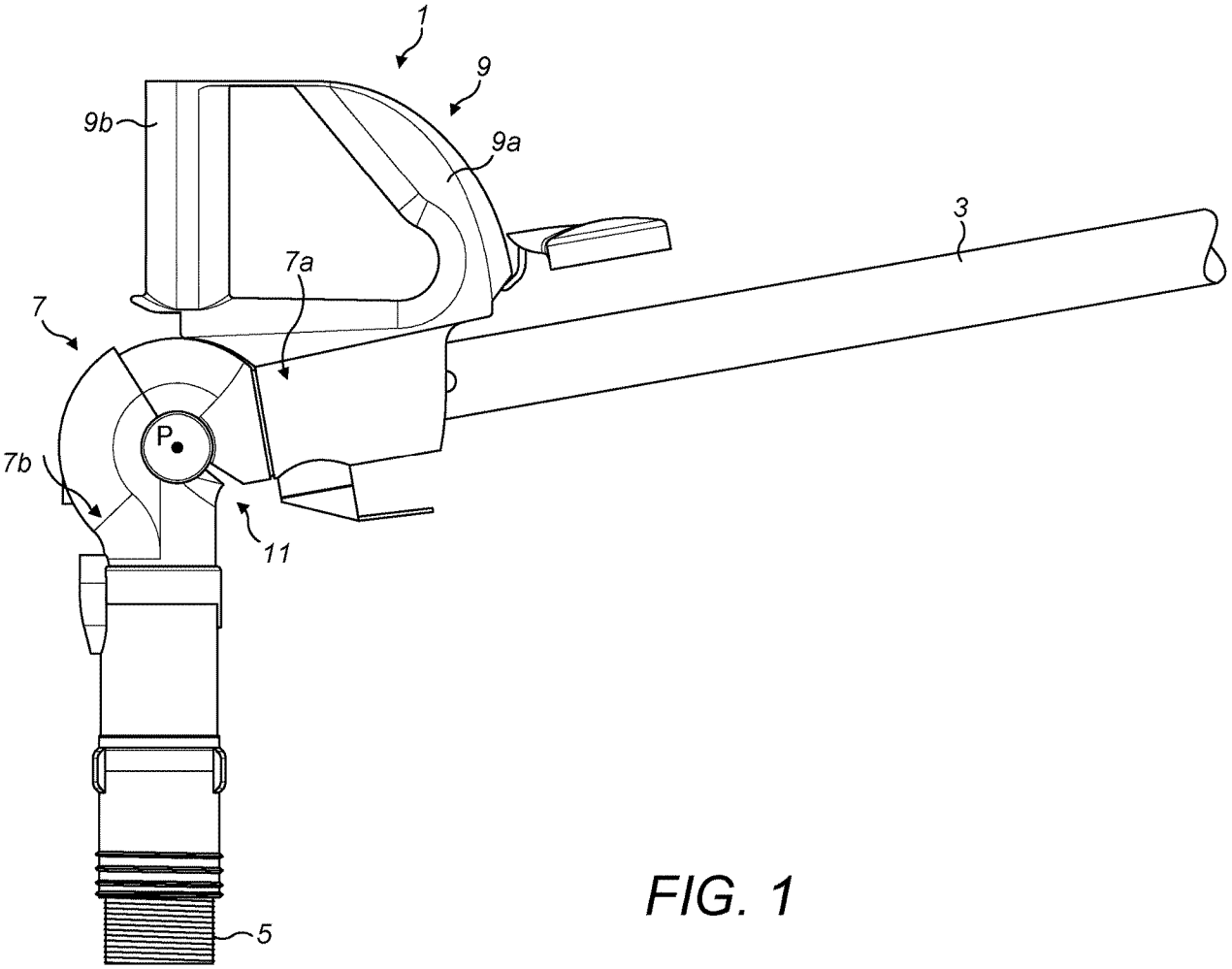
FIG. 1 is a side view of a wand and hose assembly according to the present invention.

FIG. 1 shows a wand and hose assembly 1 for a vacuum cleaner.

The wand and hose assembly 1 comprises a suction wand 3 fluidly connected to a flexible suction hose 5 by a duct 7.

The duct 7 comprises a first duct section 7*a* and a second duct section 7*b* joined to the first duct section 7*a* by an articulating joint.

A handle 9 is provided on the first duct section to make it easier for the user to manipulate the wand in use. The handle 9 comprises two grip portions 9*a*, 9*b* which provide alternative locations for the user to grip the handle 9, according to preference.

The articulating joint takes the form of an elbow joint 11, which permits relative pivoting movement of the duct sections 7*a*, 7*b* about a single pivot axis, P, whilst maintaining fluid connection between the duct sections 7*a*, 7*b*.

Figure 2:
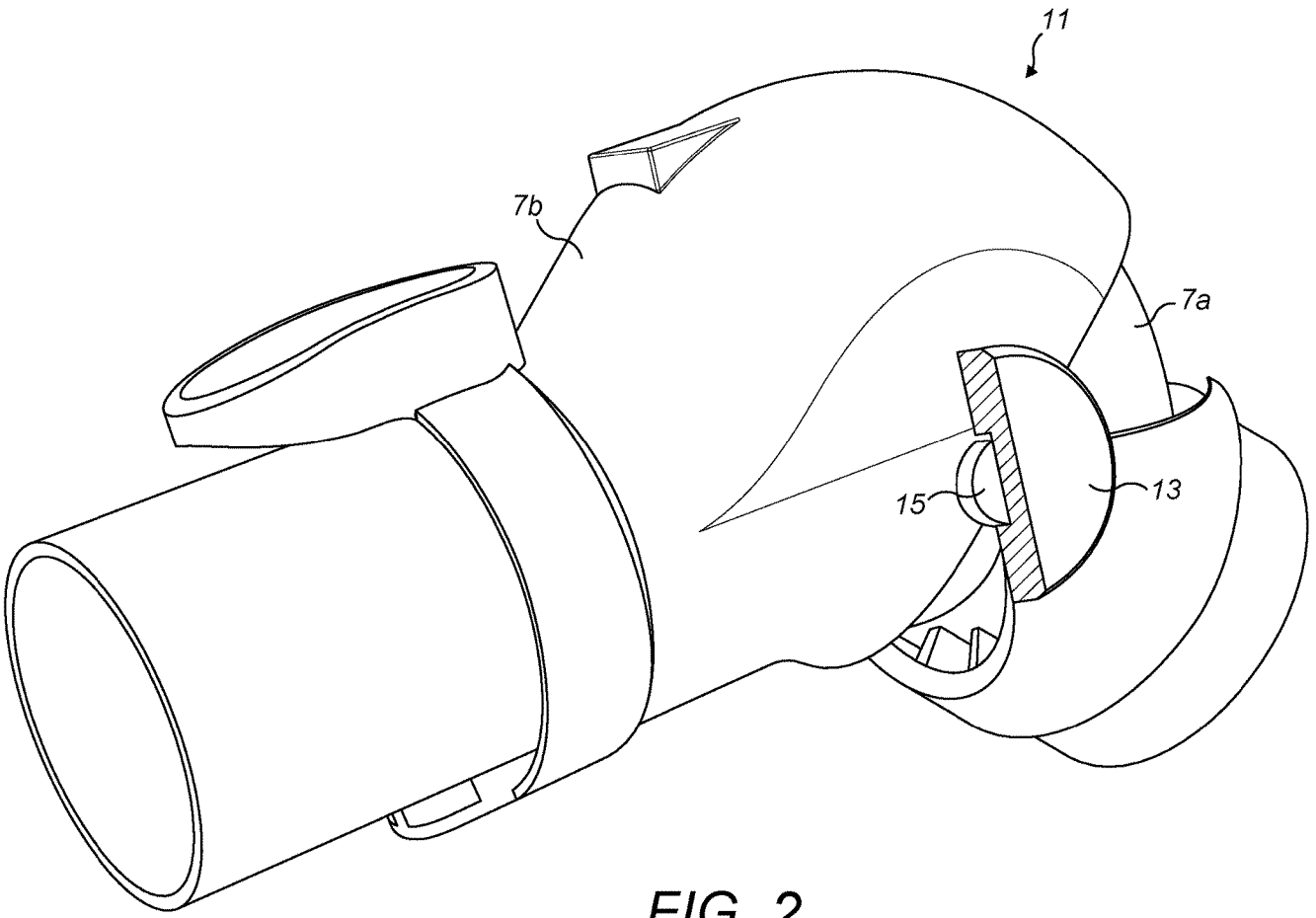
FIG. 2 is a perspective view showing an elbow joint assembly, part of which has been sectioned to help illustrate the pivotal connection between a first part and a second part of the assembly.

The elbow joint 11 comprises a pair of yoke arms 13 on the first duct section 7*a* which pivotally engage with respective external trunnions 15 on an end portion of the second duct section 7*b* to define the pivot axis, P (FIG. 2—only one yoke arm 13 and one trunnion 15 is visible in the Figure).

Figure 3:
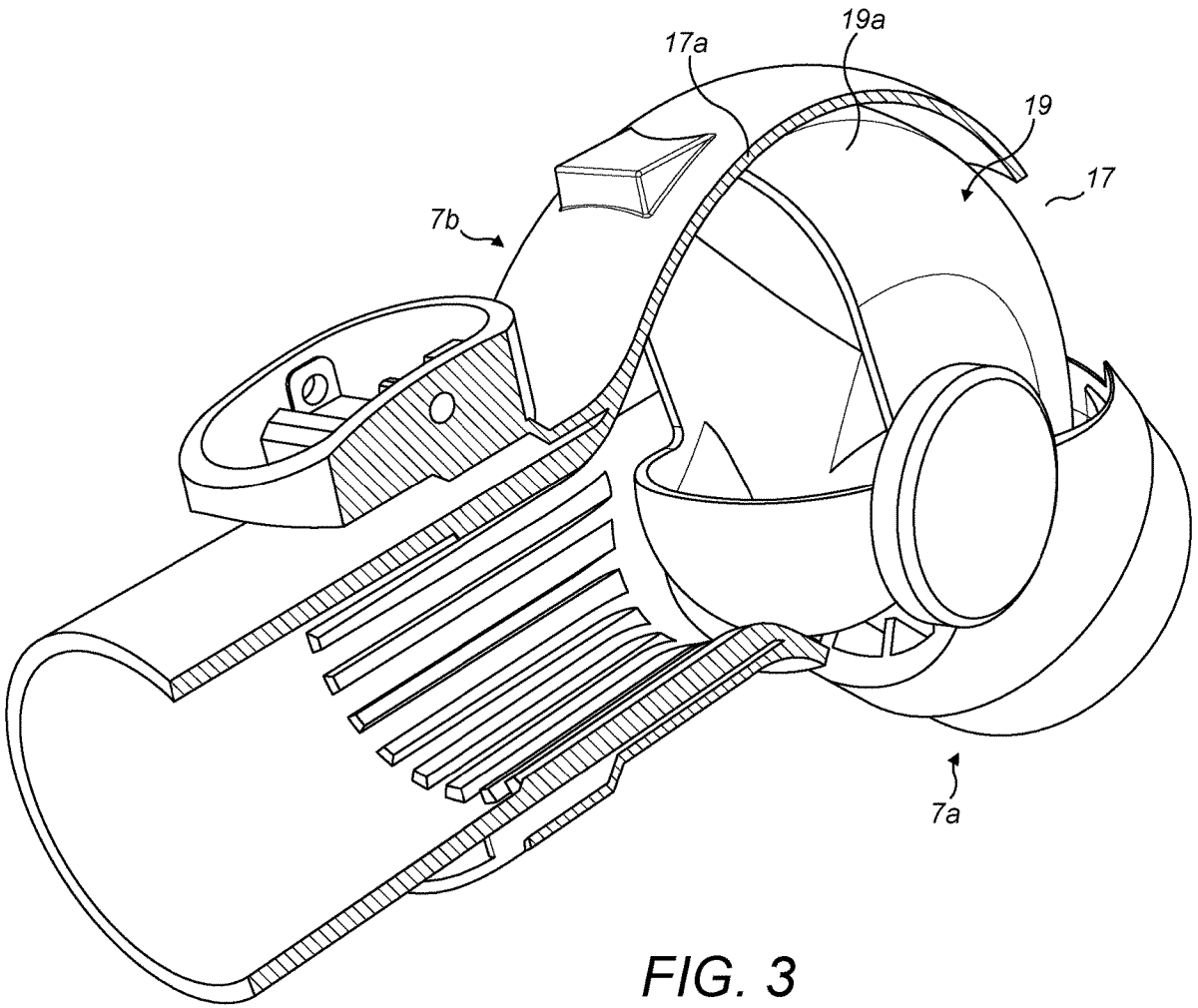
FIG. 3 is a perspective view corresponding to FIG. 2, but with the second part sectioned so that the inside of the second part is visible.
Figure 4:
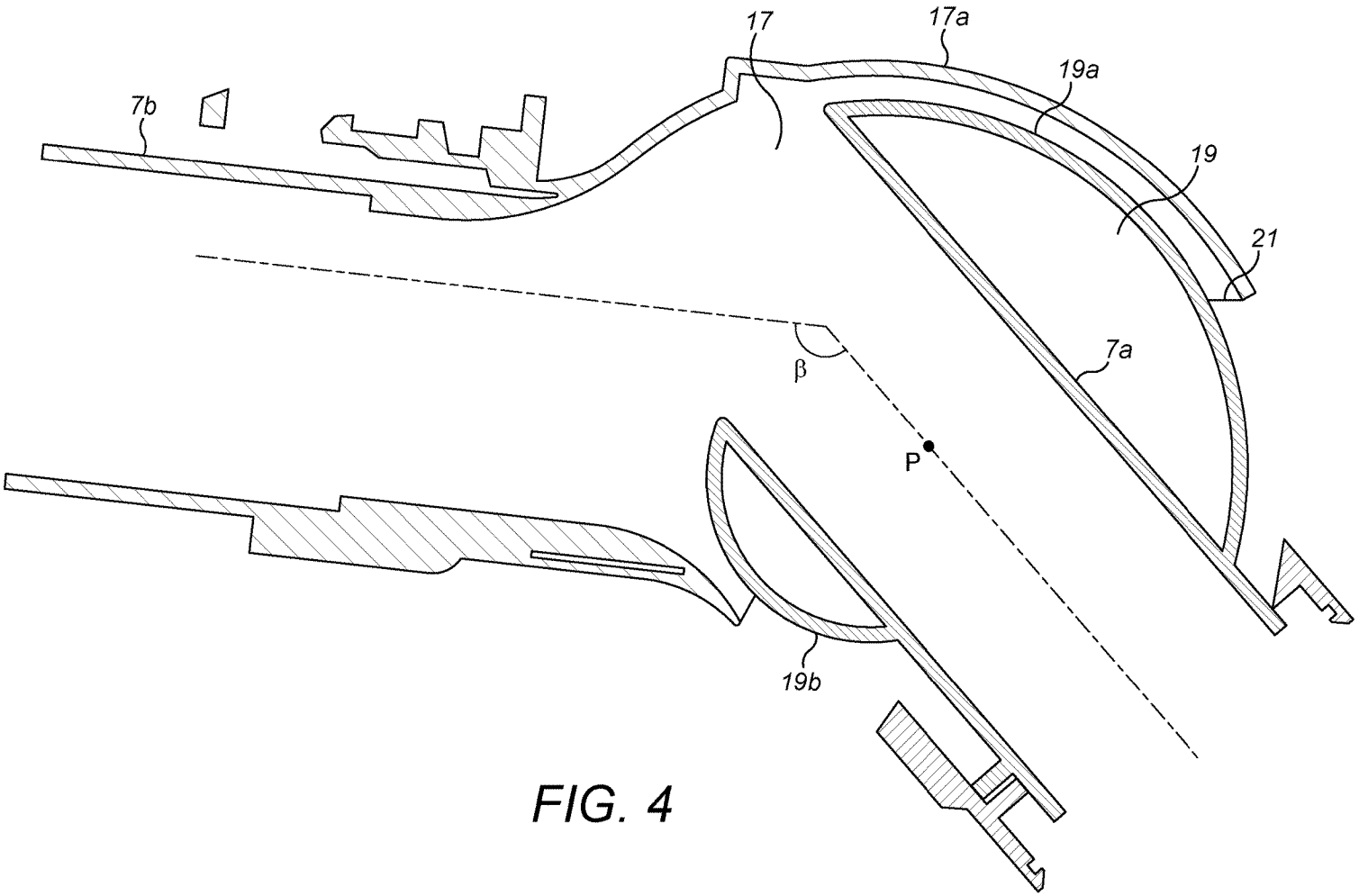
FIG. 4 is a sectional view of the elbow joint assembly shown in FIGS. 2 and 3.

The end portion of the second duct section 7*b* forms a socket 17 (FIGS. 3 and 4). The socket 17 incorporates an outer concave wall 17*a*.

A respective end portion of the first duct section 7*a* forms a head 19 which is received in this socket 17. The head 19 comprises an outer convex wall 19*a*.

A lip seal 21 is provided on the outer concave wall 17*a* of the socket 17, in the space between the socket 17 and the head 19. The lip seal 21 seals against the outside of the head 19 to provide a dynamic air seal between the duct sections 7*a*, 7*b*.

The outer concave wall 17*a* and the outer convex wall 19*a* are arranged concentrically about the pivot axis P, and so are shaped co-operatively to permit relative movement of the duct sections 7*a*, 7*b* about the pivot axis P. As the duct sections 7*a*, 7*b* rotate about the pivot axis P, the walls 17*a*, 19*a* rotate relative to one another about the pivot axis P in such manner as to maintain a fixed clearance in the region of the lip seal 21. This helps ensure consistent sealing between the duct sections 7*a*, 7*b*.

The head 19 on the second duct section 7*a* additionally comprises an inner convex wall 19*b* on the opposite side of the pivot axis P from the outer convex wall 19*a*. The inner convex wall 19*b* is arranged concentrically with the outer convex wall 19*a* about the pivot axis P. As the duct sections 7*a*, 7*b* rotate about the pivot axis P, the inner convex wall 19*b* thus maintains a fixed clearance with the socket 17 in the region of the lip seal 21 to help ensure consistent sealing between the duct sections 7*a*, 7*b*.

The radius of curvature of the inner convex wall 19*b* is significantly smaller than the radius of curvature of the outer convex wall 19*a*, which helps reduce the overall size of the elbow joint 11, making it more slim-line.

The elbow joint 11 can move in-between a straight-arm position and a bent-arm position in order to vary the working angle, β between the hose 5 and the wand 3 by up to 100 degrees.

Figure 5:
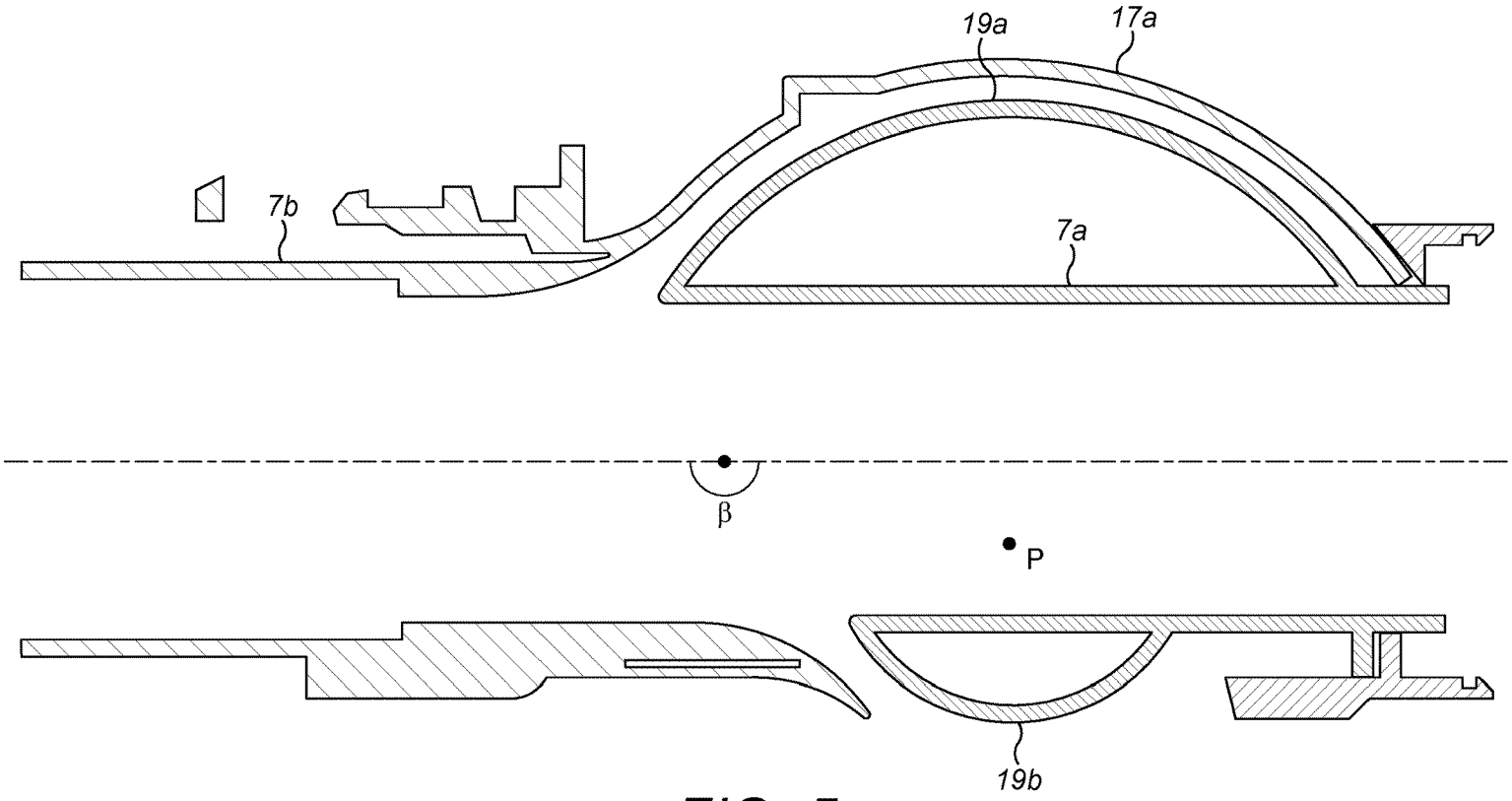
FIG. 5 is a sectional view corresponding to FIG. 4, with the elbow joint in a straight-arm position.

FIG. 5 shows the elbow joint 11 in the straight-arm position. This is the position corresponding to a maximum working angle of around 180 degrees between the hose 5 and the wand 3. The ducts sections 7*a*, 7*b* are co-axially aligned with one another. The first duct section 7*a* abuts against the second duct section 7*b* to prevent further rotation of the first duct section 7*a* beyond the straight-arm position (i.e. in an anti-clockwise direction in FIG. 5).

Figure 6:
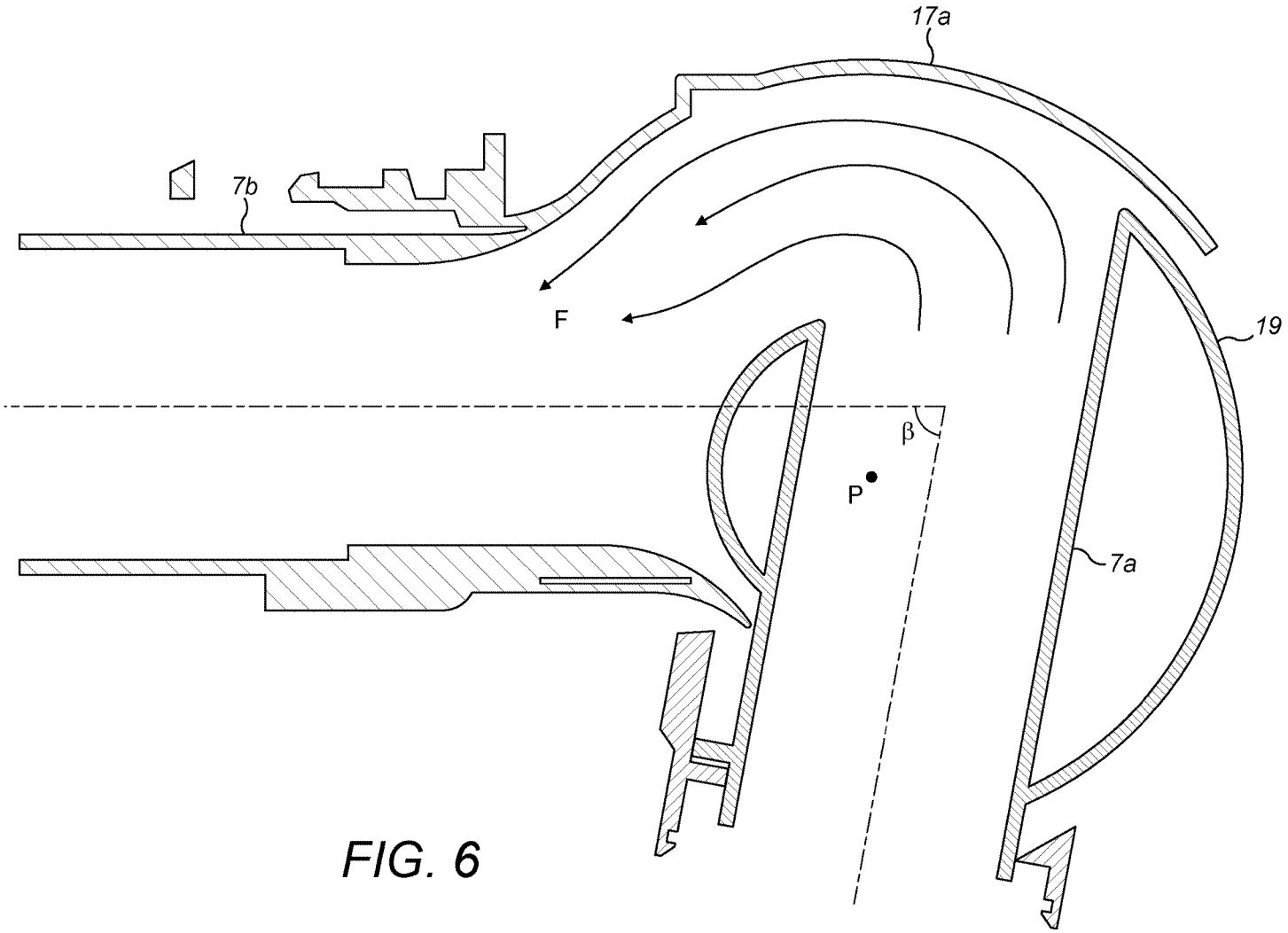
FIG. 6 is a sectional view corresponding to FIG. 4, with the elbow joint in a bent-arm configuration.

FIG. 6 shows the elbow joint 11 in the bent-arm position. This is the position corresponding to a minimum working angle of around 80 degrees between the hose 5 and the wand 3.

In this position, the open end of the first duct section 7*a* faces the outer concave wall 17*a* of the socket 17 and the concave wall 17*a* of the socket 17 acts to guide the airflow F around the elbow, reducing pressure losses in the duct 7.

The first duct section 7*a* abuts against the second duct section 7*b* to prevent further rotation beyond the bent-arm position (i.e. in a clockwise direction in FIG. 6).

In use, the suction hose 5 is connected to a vac-motor on board the vacuum cleaner. The user manually manoeuvres the suction wand 3 into the area where he (or she) wants to clean and the vac motor draws dirty air in through the suction wand 3, into the duct 7 between the wand 3 and the suction hose 5, along the suction hose 5 and then into a dust separator mounted on the vacuum cleaner.

As the user manipulates the wand 3, the elbow joint 11 provides for articulated movement of the wand 3 relative to the suction hose 5, so that the stiffness and weight of the suction hose 5 do not unduly inhibit movement of the wand 3 by the user. This reduces fatigue for the user when compared to conventional wand and hose assemblies in which the end of the hose is essentially fixedly attached to the end of the wand.

Figure 7:
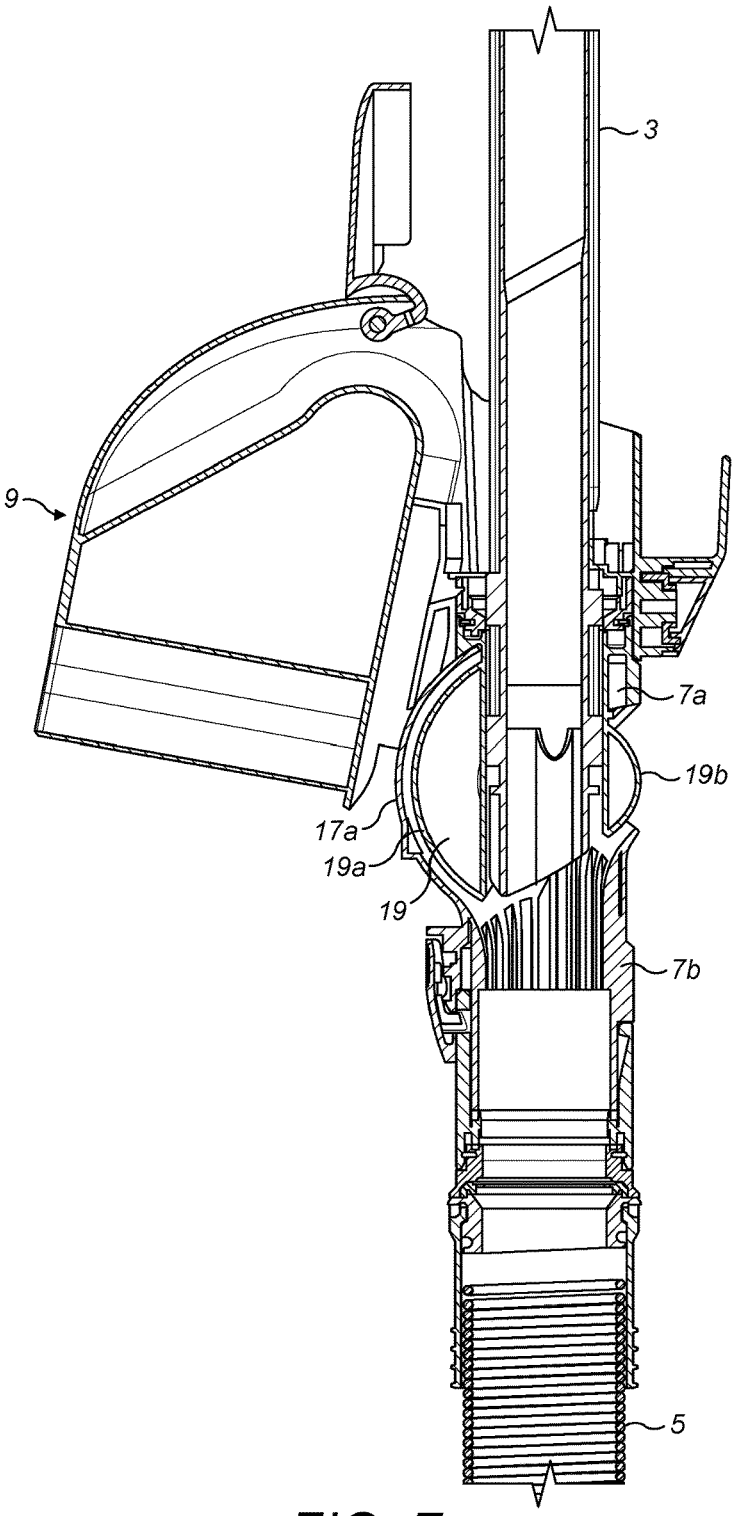
FIG. 7 is a sectional view through a wand and hose assembly, with the wand in an extended position.
Figure 8:
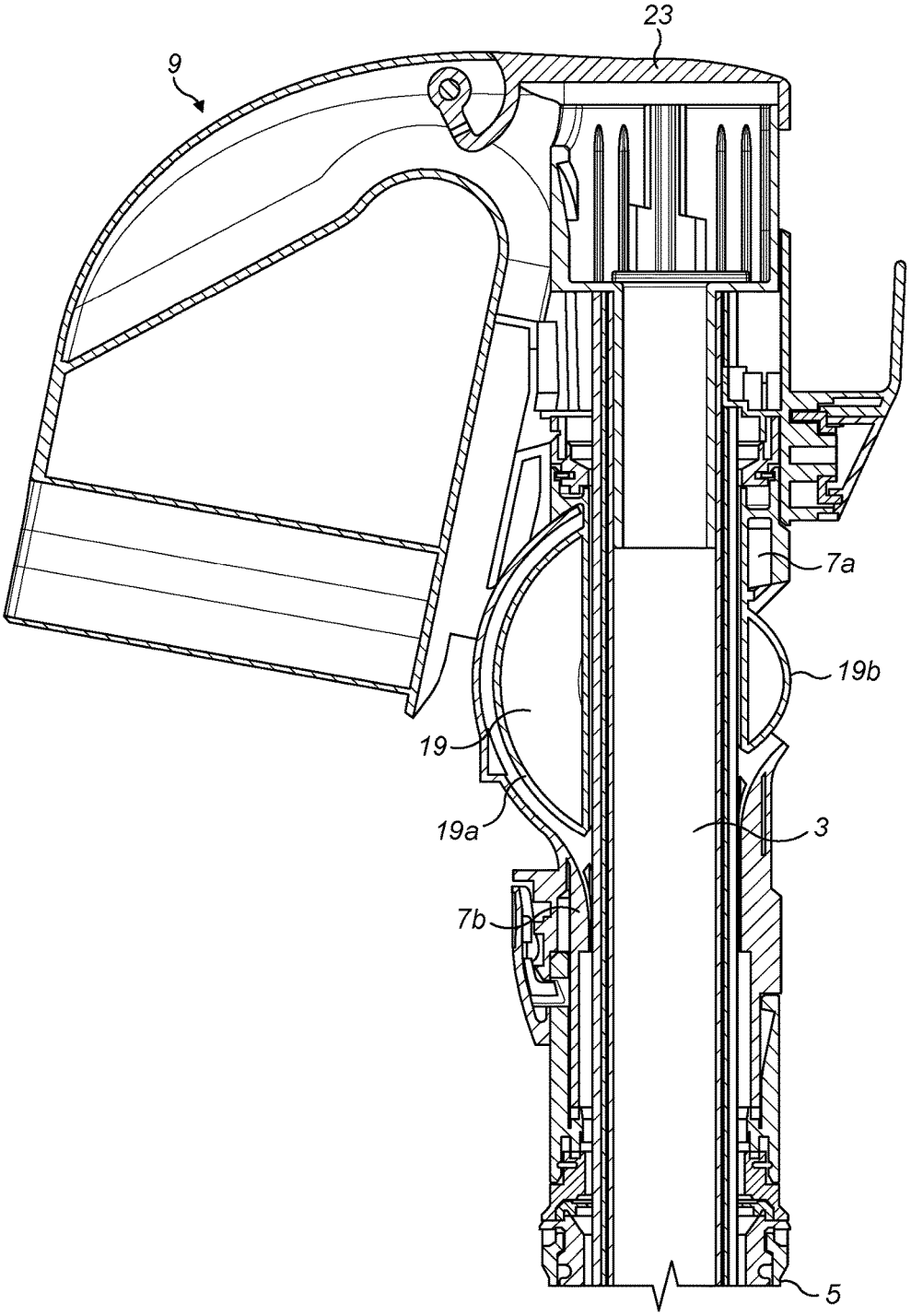
FIG. 8 is a sectional view through a wand and hose assembly, with the wand in a retracted position.

The suction wand 3 is telescopically mounted to the first duct section 7*a* so that when the wand 3 is not being used it can be slide-retracted through the duct 7 and into the suction hose 5 to reduce the storage 'footprint' of the wand and hose assembly 1. This is made possible by the arrangement of the elbow joint 11. In order to retract the wand 3, the user simply moves the elbow joint 11 into the straight-arm position (FIG. 7), thus aligning the duct sections 7*a*, 7*b* so that the wand 3 can then be retraced through the duct 7 and into the suction hose 5 (FIG. 8).

In the retracted position, the end of the wand 3 projects out slightly from the end of the first duct section 7*a* so that the user can grab the end of the wand and manually move the wand into its extended position, as required. A hinged wand cap 23 is provided on the handle 9 which can be closed over the end of the wand 3 to prevent debris entering the wand 3 when it is not in use.

A catch may be provided between the wand 3 and the first duct section 7*a* to lock the wand in its extended position. A conventional type of wand catch can be used. Alternatively, the suction wand 3 may be arranged for frictional engagement with the first duct section 7*a* in order to retain the wand in the extended position during normal use.

Figure 9:
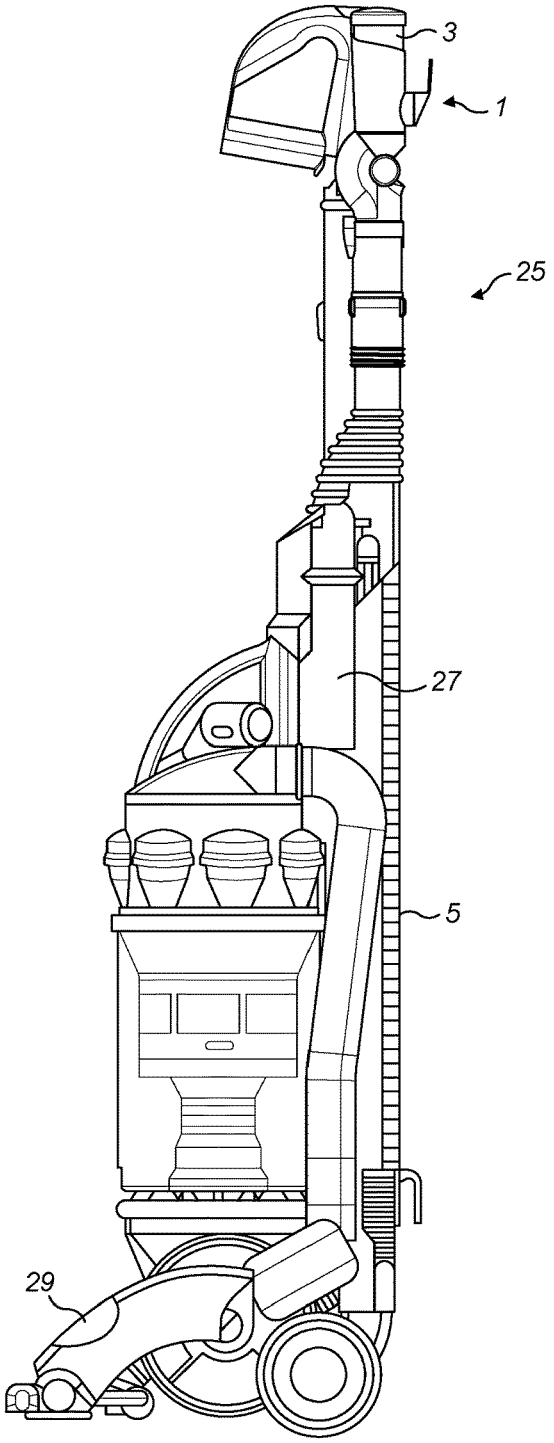
FIG. 9 is a side view of an upright vacuum cleaner incorporating a wand and hose assembly according to the present invention, in which the wand is in its storage position.

FIG. 9 shows the wand and hose assembly 1 on an upright vacuum cleaner 25, with the wand 3 in its storage position retracted inside the hose 5. The hose 5 is fixedly secured to a suction inlet (not visible) at the base of the vacuum cleaner 25.

The ability to retract the wand into the hose is particularly advantageous on an upright cleaner because the wand is stored onboard the cleaner when the vacuum cleaner is being used in upright mode. The arrangement also has the benefit that the handle 9 can be used as the main handle for manoeuvring the vacuum cleaner 25 in upright mode.

When it is required to use the wand 3, the wand 3 can be released from the upright body 27 of the vacuum cleaner 25—so that the wand 3 is effectively connected to the upright body only by the suction hose 5—and moved into its extended position (a conventional changeover valve may be provided to switch suction from the cleaner head 29 to the wand 3, as desired).

With the wand 3 in its extended position, the articulated duct 7 then provides the benefit of articulating movement of the wand 3 relative to the suction hose 5.

The wand 3 can be retracted again, as desired, simply by manipulating the wand 3 to move the elbow joint 11 into the straight arm position and, if necessary, releasing any catch locking the wand in its extended position before retracting the wand 3 through the duct 7 and into the hose 5.

The particular design of the elbow joint may vary. For example, the articulated duct may comprise two duct sections fluidly connected by a short length of flexible tube, optionally stabilised by an external pin joint such as the one provided by the yolk arms 13 and trunnions 15. The stiffness of the flexible tube can be controlled so that it does not unduly inhibit relative pivoting movement of the duct sections and thus does not hinder satisfactory articulation of the duct.

Alternatively, the articulating joint may be a hollow ball joint rather than an elbow joint. This has the advantage of providing more than one degree of freedom for the joint and so improves the articulation of the wand relative to the hose. In this sort of arrangement, it may be desirable to provide means by which the ball joint can conveniently be centred so that the wand can be retracted through the duct. This could be achieved using simple indicia or markings which allow the user visually to align the duct sections.

The invention claimed is:

1. A wand and hose assembly for a vacuum cleaner, the assembly comprising a suction wand fluidly connected to the end of a suction hose by a duct, the duct incorporating an articulating joint for allowing articulated movement of the suction wand relative to the end of the suction hose, the wand and the duct being arranged for telescopic sliding movement relative to one another, the articulating joint being moveable into a position in which the wand can slide telescopically through the duct for retraction into the suction hose.

2. The wand and hose assembly of claim 1, in which the articulating joint is an elbow joint permitting movement about a single pivot axis, the elbow joint being moveable between a bent-arm position and a straight-arm position, the straight-arm position corresponding to a position in which the wand can slide telescopically through the duct for retraction into the suction hose.

3. The wand and hose assembly of claim 2, in which the elbow joint permits sufficient relative rotation of the wand and hose about the pivot axis to vary a working angle between the hose and the wand by 100 degrees.

4. The wand and hose assembly of claim 2, in which the duct comprises a first rigid duct section and a second rigid duct section joined to the first duct section by the elbow joint.

5. The wand and hose assembly of claim 4, in which the elbow joint comprises a socket formed at the end of the first duct section which receives a head formed at the respective end of the second duct section, the socket and the head being shaped co-operatively to permit relative movement of the duct sections about the pivot axis, a lip seal member being provided between in a space between the socket and the head to provide a dynamic air seal between the duct sections.

6. The wand and hose assembly of claim 5, wherein the lip seal forms a seal against one or more convex walls on the head, the one or more convex wall arcing around the pivot axis.

7. The wand and hose assembly of claim 5, wherein the socket comprises an outer concave wall that, when the elbow joint is in the bent-arm position, acts to guide airflow around the elbow.

8. The wand and hose assembly of claim 5, in which the elbow joint additionally comprises an external pin joint between the duct sections and the pin joint defines the pivot axis.

9. The wand and hose assembly of claim 4, wherein a handle is provided on the second duct section.

10. The wand and hose assembly of claim 9, in which the handle forms a closed loop with the second duct section.

11. The wand and hose assembly of claim 10, wherein the handle comprises two separate grip portions.

12. An upright vacuum cleaner comprising a wand and hose assembly, the assembly comprising a suction wand fluidly connected to the end of a suction hose by a duct, the duct incorporating an articulating joint for allowing articulated movement of the suction wand relative to the end of the suction hose, the wand and the duct being arranged for telescopic sliding movement relative to one another, the articulating joint being moveable into a position in which the wand can slide telescopically through the duct for retraction into the suction hose.

* * * * *